US009021668B2

(12) United States Patent
Hui

(10) Patent No.: US 9,021,668 B2
(45) Date of Patent: May 5, 2015

(54) PAPER COFFIN

(71) Applicant: Darrell Ting-Cheung Hui, Calgary (CA)

(72) Inventor: Darrell Ting-Cheung Hui, Calgary (CA)

( * ) Notice: Subject to any disclaimer, the term of this patent is extended or adjusted under 35 U.S.C. 154(b) by 0 days.

(21) Appl. No.: 14/455,909

(22) Filed: Aug. 10, 2014

(65) Prior Publication Data

US 2014/0352120 A1 Dec. 4, 2014

(51) Int. Cl.

*A61G 17/007* (2006.01)
*A61G 17/02* (2006.01)
*A61G 17/00* (2006.01)

(52) U.S. Cl.

CPC ..... *A61G 17/0073* (2013.01); *A61G 17/02* (2013.01); *A61G 2017/004* (2013.01)

(58) Field of Classification Search

CPC ..... A61G 17/02; A61G 17/0073; A61G 2017/00; A61G 2017/004; A61G 17/00; B65D 5/2009; B65D 5/24; B65D 5/241; B65D 5/445; B65D 5/446; B65D 5/64

USPC ..... 27/2, 4, 14, 19; 229/125.01, 165, 166, 229/186, 190, 199, 199.1

See application file for complete search history.

(56) References Cited

U.S. PATENT DOCUMENTS

| | | | | | |
|---|---|---|---|---|---|
| 5,307,545 | A * | 5/1994 | Stoltz | 27/4 |
| 5,586,679 | A * | 12/1996 | Thomas | 27/4 |
| 5,771,549 | A * | 6/1998 | Saaf | 27/4 |
| 5,815,898 | A * | 10/1998 | Jenkins | 27/4 |
| 6,145,175 | A * | 11/2000 | Enneking et al. | 27/4 |
| 6,615,464 | B2 * | 9/2003 | Tambussi | 27/4 |
| 6,694,579 | B2 * | 2/2004 | Belanger et al. | 27/4 |
| 8,151,421 | B2 * | 4/2012 | Hsu et al. | 27/4 |
| 8,356,392 | B2 * | 1/2013 | Jackson | 27/4 |

* cited by examiner

*Primary Examiner* — William Miller

(74) *Attorney, Agent, or Firm* — Pro-Techtor International Services

(57) ABSTRACT

A paper coffin is an architecture made of corrugated cardboards, including a main body, a lid and two flat-panels. The structure of main body and lid are both identical, formed by folding a large cardboard and placing with two each long and short paperboards. Without the use of a nail or screw, a paper coffin can be erected. Moreover, laying two flat-panels of different direction honeycomb arrangement inside the main body increases the capability of the main body to carry. Because when shipped from the factory, the paper coffin is in a flattened condition and vacuum packaging, it can save a lots stocking space. The users do not need to use any glue or tape to assemble, so the assembly is not only simple, fast, and also has a cost-saving and environmental protection concept.

2 Claims, 4 Drawing Sheets

A-A

PAPER COFFIN

CROSS-REFERENCE TO RELATED APPLICATIONS

N/A

BACKGROUND OF THE INVENTION

1. Field of the Invention

The invention relates to a paper coffin, especially a fully assembled with corrugated cardboards, users do not need to use any glue or tape to assemble. In addition to simple and fast assembling, it is also environmentally friendly and cost-saving.

2. Prior Art

The traditional-style coffin is mostly made of wood nailed together, the wooden coffin must be assembled with nails or screws and it is big volume and heavy weight. For the concern of transport, it is unable to reduce the measurement and save the cost of transporting.

Moreover, to make the wooden coffin, it is necessary to cut down trees for acquiring the wood and will eventually destroy the environment and soil and water conservation. When cremation, the burning time is longer, it can not effectively reduce carbon emissions and does not comply with environmental requirements.

Therefore, the people in this business developed the coffins made of paper, because the strength of paper is less than wood, it is necessary to superimpose several cardboards to increase the robustness of the overall combination. The technology of multi-chip stacked assembly, snap fitting or bonding is too complicated for the general users to assemble the paper coffin themselves. Especially the whole paper coffin is subject to pre-assembled before shipment, it takes up a lot of space and reduces the carrying capacity, so the cost is relatively increased, therefore needs to be improved.

BRIEF SUMMARY OF THE INVENTION

The main purpose of this invention is to provide a paper coffin, by using two expanded sheets of corrugated cardboard, one erected into the main body, another erected into the lid, and then two flat-panels of corrugated cardboard laid insides. Users do not need to use glue or tape to assemble, so they can easily and quickly assemble a paper coffin. When shipped from the factory, the paper coffin is in a flattened condition and vacuum packaging to save stocking space.

To achieve the above object, the invention uses the following techniques:

A paper coffin includes:

A main body consists of a cardboard, two long and two short paperboards. A cardboard contains the bottom, left, right, front and rear plates. A connecting piece respectively bridges between the left/right plate and the front/rear plate, a concave crease is set at the diagonal of connecting piece. At the outer side of the left, right, front and rear plate, there is a crease respectively connected to a cover plate; opposite, there is also a crease respectively connected to the bottom plate at the inner side of the left, right, front and rear plate.

A lid, which covers the main body and is the same structure of the main body, only the volume is slightly larger than the volume of the main body.

Two flat-panels, to be placed in a vertically superimposed manner on the bottom plate of the main body.

BRIEF DESCRIPTION OF THE DRAWINGS

In order to make the examiner for a better understanding of the invention, here combined with a detailed description of the drawings as follows.

DETAILED DESCRIPTION OF THE PREFERRED EMBODIMENT

Figure 1:
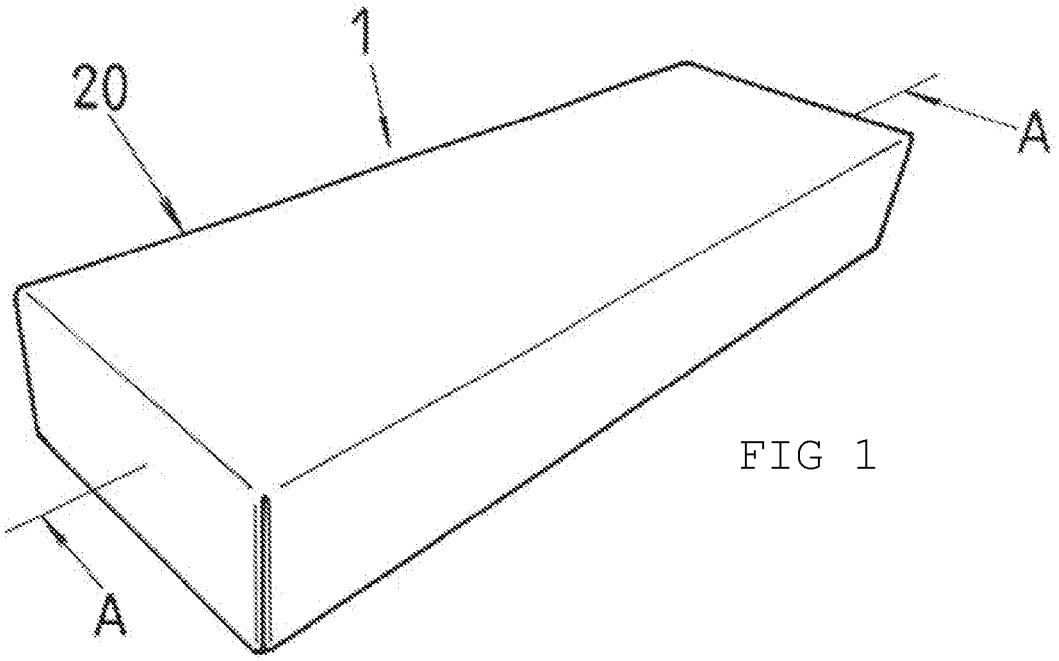
FIG. 1 is the exterior structure of the invention.
Figure 2:
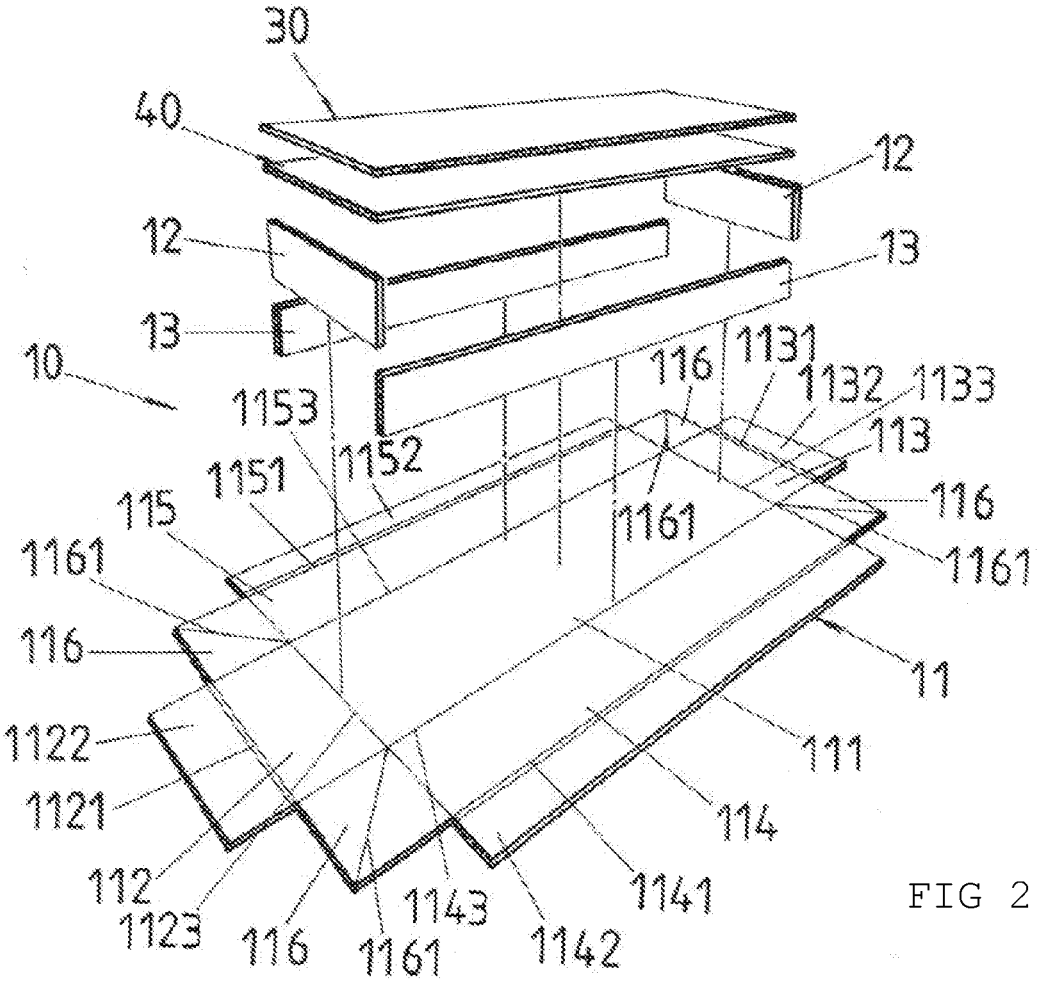
FIG. 2 is an exploded view of the invention.

Referring to FIG. 1 and FIG. 2, a paper coffin 1 consists of a main body 10, a lid 20, and two flat-panels 30 & 40. The structure and composition of the main body 10 made of corrugated cardboard is the same as the lid 20, but the volume of lid 20 is slightly larger than the volume of main body 10 to facilitate the lid 20 to cover on the main body 10. Two flat-panels made of corrugated cardboard 30 and 40 are placed in a vertically superimposed manner on the bottom plate of the main body 10, the flat-panel 30 has a different honeycomb arrangement structure from the other flat-panel 40. The honeycomb arrangement of upper flat-panel 30 is vertical form while the lower flat-panel 40 is arranged transversely to increase the bearing strength of the bottom of the body 10.

Since the structure of the main body 10 and lid 20 are the same, so the following description is based on the main body 10 only as a representative, the structure of the lid 20 will not repeat. The main body 10 is a structure consisting of a larger cardboard 11, two short paperboards 12 and two long paperboards 13; the cardboard 11 made of corrugated cardboard includes a bottom plate 111, a left plate 112, a right plate 113, a front plate 114 and a rear plate 115. There is a connecting piece 116 bridging respectively between the left, right, front and rear plate 112, 113, 114 and 115, a concave crease 1161 set at the diagonal of connecting piece 116; Further, the outer side of the left, right, front and rear plates 112, 113, 114 and 115 are respectively connected to a crease 1121, 1131, 1141, 1151. Outside the crease 1121, 1131, 1141, 1151, they are respectively connected with a cover plate 1122, 1132, 1142, 1152; the inner side of the left, right, front and rear plates 112, 113, 114 and 115 are respectively connected to the bottom plate 111 with a fold line 1123, 1133, 1143, and 1153.

Figure 3:
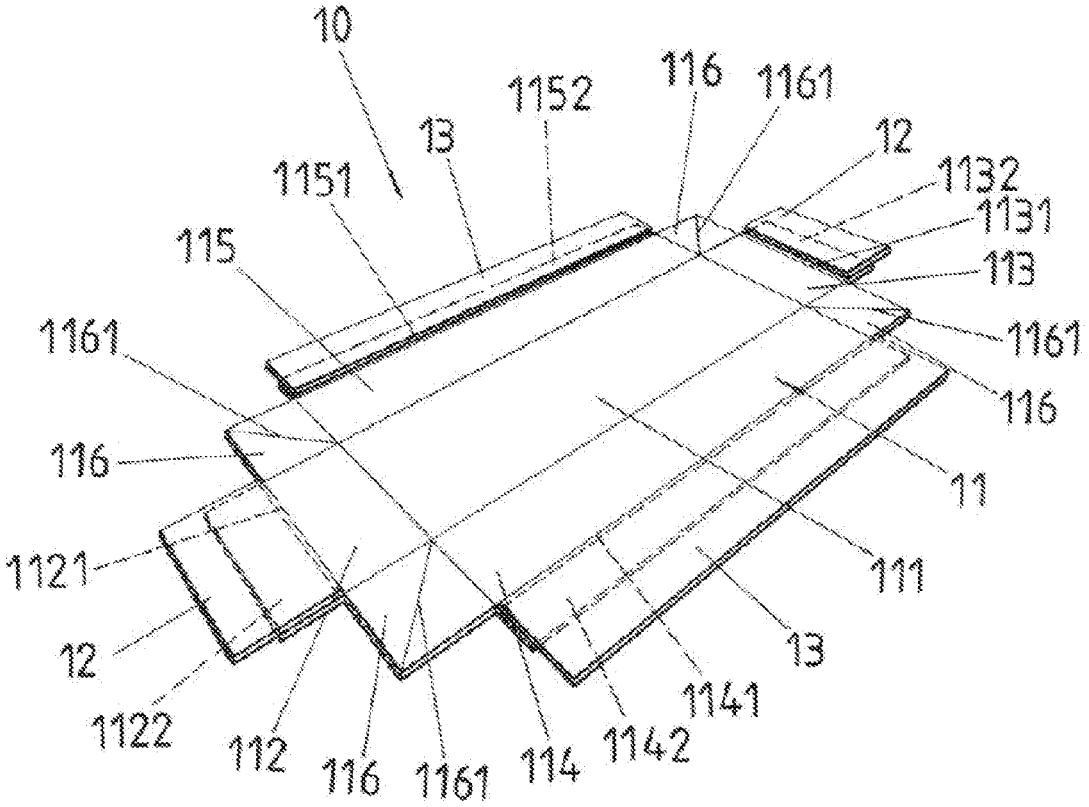
FIG. 3 is a schematic plan view of the body after the commencement.
Figure 4:
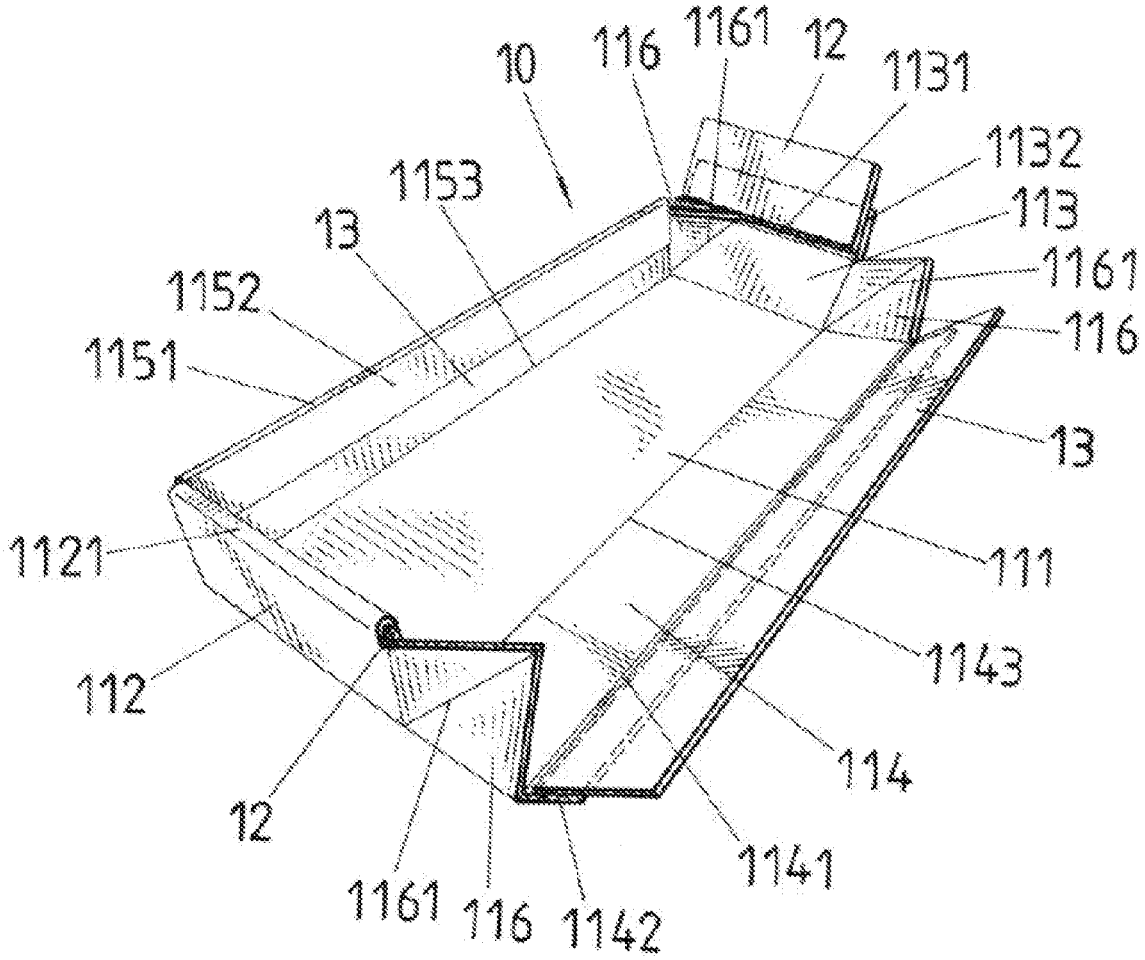
FIG. 4 is a schematic architecture of the body folded flat.

In accordance with FIG. 2 of an exploded view of the invention, in which the main body 10 of paper coffin 1 produced in a factory before shipment, the two long and two short paperboards 13 and 12 are bonded to the two cover plates 1142, 1152 and the two side cover plates 1122, 1132 by hot glue gun (as shown in FIG. 3) to become one. When the paper coffin shipped from the factory, it is fully flattened and in a vacuum-packed plastic bag to save stocking space. When consumers buy a vacuum packaged paper coffin 1, they can quickly fold it into a three-dimensional coffin, folding steps are as follows:

1. Referring to FIG. 4, firstly fold all the recesses 1161 on the 4 connecting pieces 116 at the 4 corners into a triangular shape and bond them to the left and right plates 112 and 113.

2. Then bend the fold line 1123, 1133, 1143 and 1153 at the inner side of the left, right, front and rear plates 112, 113, 114 and 115 so that the left, right, front and rear plates become vertical erected.

Figure 5:
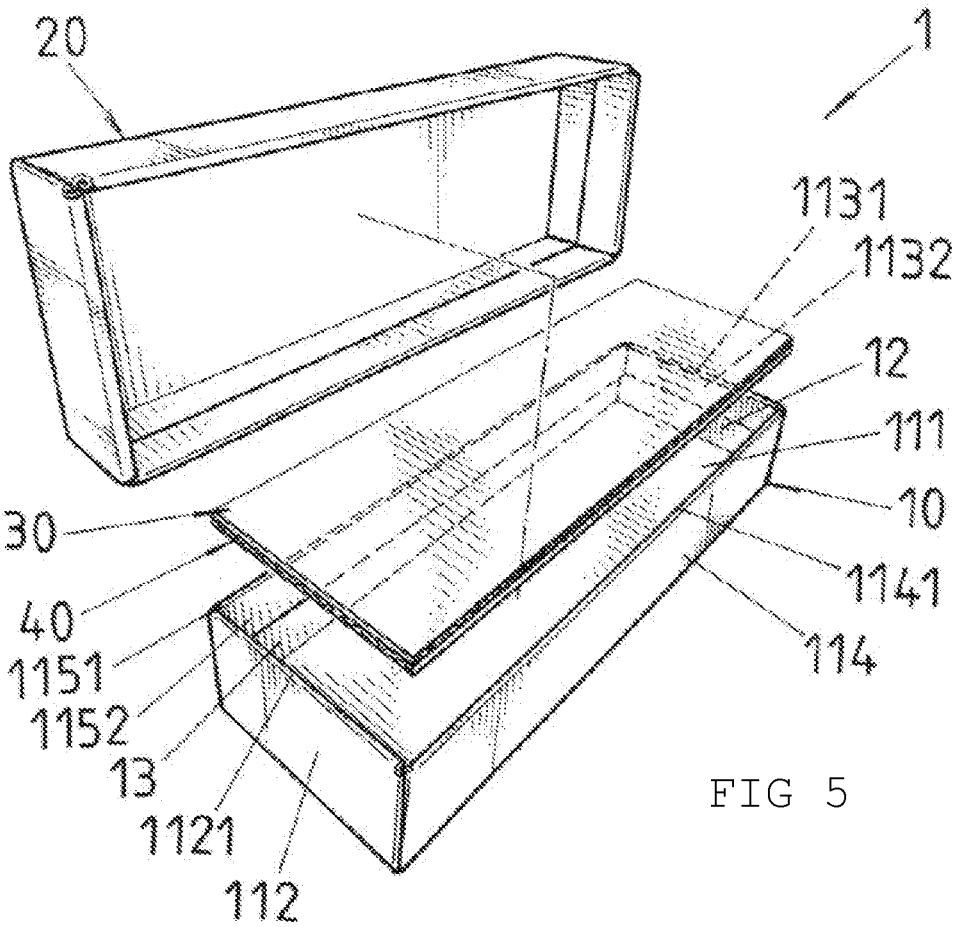
FIG. 5 is an exploded perspective view of the invention.

3. Finally, place the two flat-panels 30, 40 in a vertically superimposed manner on the bottom plate 111 (e.g. FIG. 5). Then the folded combination forms the main body 10 of the paper coffin 1.

Figure 6:
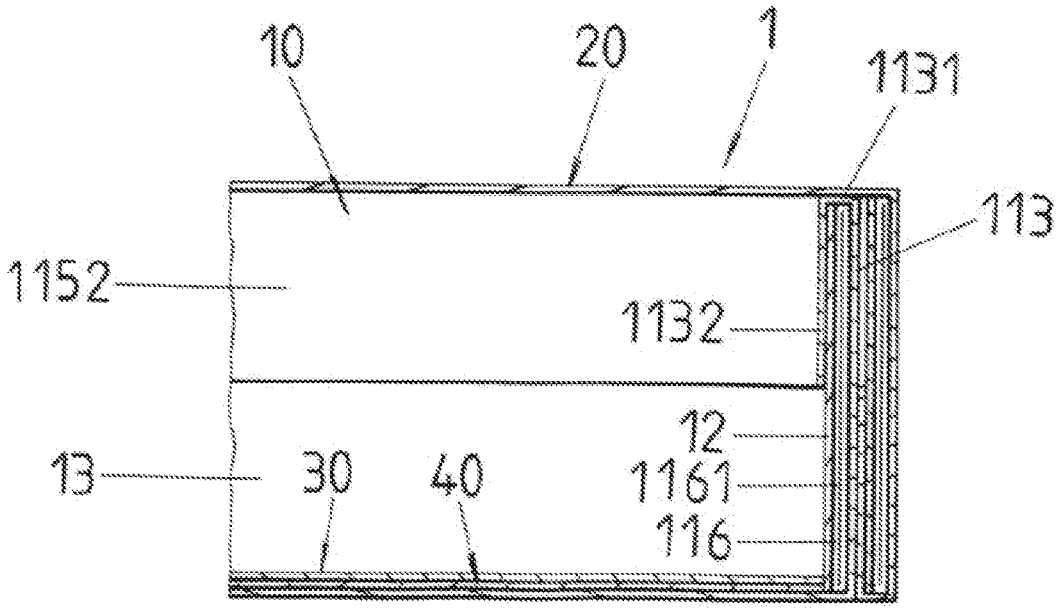
FIG. 6 is a sectional view of portion AA in FIG. 1.

As shown in FIG. 1 and FIG. 6, after the main body 10 made of corrugated board is covered by the same style hood lid 20, they are combined into a lightweight, low-cost, and environmentally friendly coffin.

In summary, this invention paper coffin, is different from the traditional method of making paper coffins, and as an innovative paper coffin, in addition to the characteristics of the general paper coffin, such as lightweight, low cost and environmental, and able to take into account the ability of those wooden coffins carrying the weight. Its practical efficacy is beyond doubt, and this invention has never been made public or is found in other publications, it has met the requirements of the Patent Law, so the inventor would like to file a patent application in accordance with law.

LEGEND (1) Paper coffin
(10) Main body
(11) Cardboard
(111) Bottom plate
(112) Left plate
(113) Right plate
(114) Front plate
(115) Rear plate
(1121, 1131, 1141, 1151) Crease
(1122, 1132, 1142, 1152) Cover plate
(1123, 1133, 1143, 1153) Fold line
(116) Connecting piece
(1161) Concave crease
(12) Short paperboard
(13) Long paperboard
(20) Lid
(30, 40) Flat-panel

The invention claimed is:

1. A paper coffin consisting of: a foldable, creased cardboard main body, wherein the cardboard main body forms bottom, left, right, front and rear plates; two long and two short paperboards; a lid, which covers the main body and is of the same shape as the main body, only the volume is slightly larger than the volume of the main body; and two flat-panels placed in a vertically superimposed manner on the bottom plate of the main body, a connection piece respectively bridging between the left, right, front and rear plates, a concave crease is set at each diagonal of each connecting piece, wherein on an outer side of the left, right, front and rear plate, there is a crease respectively connected to a cover plate; there is also a crease respectively connected to the bottom plate at an inner side of the left, right, front and rear plate.

2. The paper coffin of claim 1, wherein the two flat-panels are made of corrugated cardboard, and where the honeycomb arrangement of the two flat panels differ.

* * * * *